US006329802B1

(12) United States Patent
Feldman

(10) Patent No.: US 6,329,802 B1
(45) Date of Patent: Dec. 11, 2001

(54) METHOD AND APPARATUS FOR PROGRAMMABLE POWER CURVE AND WAVE GENERATOR

(75) Inventor: Alan S. Feldman, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/575,960

(22) Filed: May 23, 2000

(51) Int. Cl.[7] ..... G05F 1/46
(52) U.S. Cl. ..... 323/288; 323/901
(58) Field of Search ..... 323/273, 280, 323/282, 288, 312, 351, 901

(56) References Cited

U.S. PATENT DOCUMENTS

| | | | | |
|---|---|---|---|---|
| 3,851,276 | * | 11/1974 | Kaplan | 331/108 D |
| 4,209,738 | | 6/1980 | Nuver et al. . | |
| 4,262,234 | | 4/1981 | Dakroub . | |
| 4,503,364 | | 3/1985 | Engel . | |
| 4,514,701 | * | 4/1985 | Machida | 330/17 |
| 4,520,450 | | 5/1985 | Snedden et al. . | |
| 4,603,282 | | 7/1986 | Close . | |
| 4,658,204 | * | 4/1987 | Goodwin | 323/285 |
| 4,902,938 | | 2/1990 | Lindquist . | |
| 5,015,938 | | 5/1991 | Carlson et al. . | |
| 5,159,260 | * | 10/1992 | Yoh et al. | 323/313 |
| 5,264,782 | | 11/1993 | Newton . | |
| 5,363,020 | | 11/1994 | Chen et al. . | |
| 5,428,267 | | 6/1995 | Peil . | |
| 5,572,094 | | 11/1996 | Yamashita et al. . | |
| 5,705,896 | | 1/1998 | Choi . | |
| 5,726,534 | | 3/1998 | Seo . | |
| 5,729,178 | * | 3/1998 | Park et al. | 330/258 |
| 5,770,939 | | 6/1998 | Edwards et al. . | |
| 5,949,665 | | 9/1999 | Seong . | |

* cited by examiner

*Primary Examiner*—Adolf Deneke Berhane

(57) ABSTRACT

A programmable control circuit is disclosed for generating a programmable power curve and ramp. The circuit includes an amplifier having both positive and negative feedback. The positive feedback including a time lag component and the negative feedback including a gain component. The circuit output is easily programmable by varying the component values and/or the input signal. In one embodiment, the rate of change of the control circuit's output waveform may be modified. In another embodiment, the circuit controls the start-up power supplied to a load. In yet another embodiment, the circuit is a waveform generator.

30 Claims, 7 Drawing Sheets

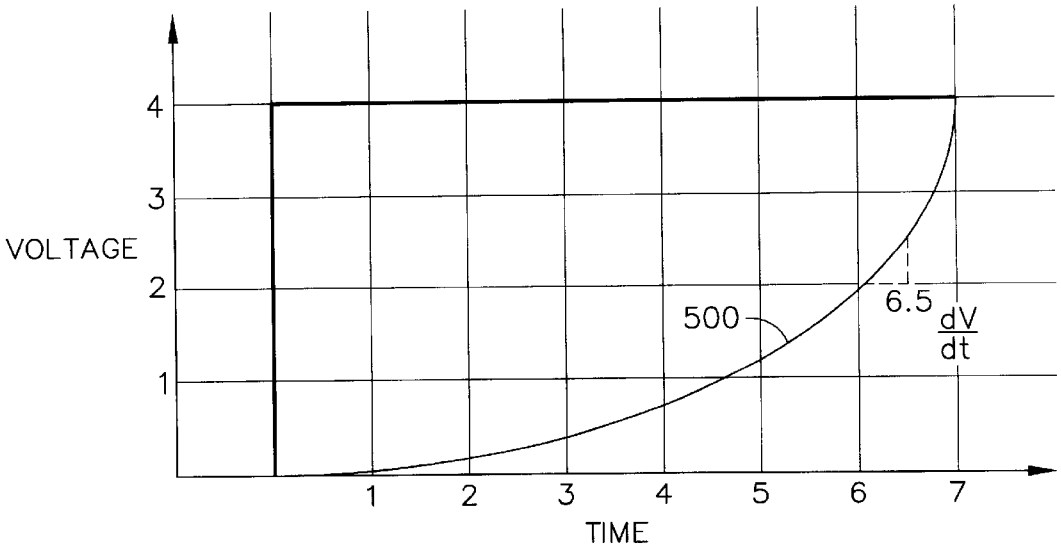
FIG. 5 DIVERGENT EXPONENTIAL WAVEFORM
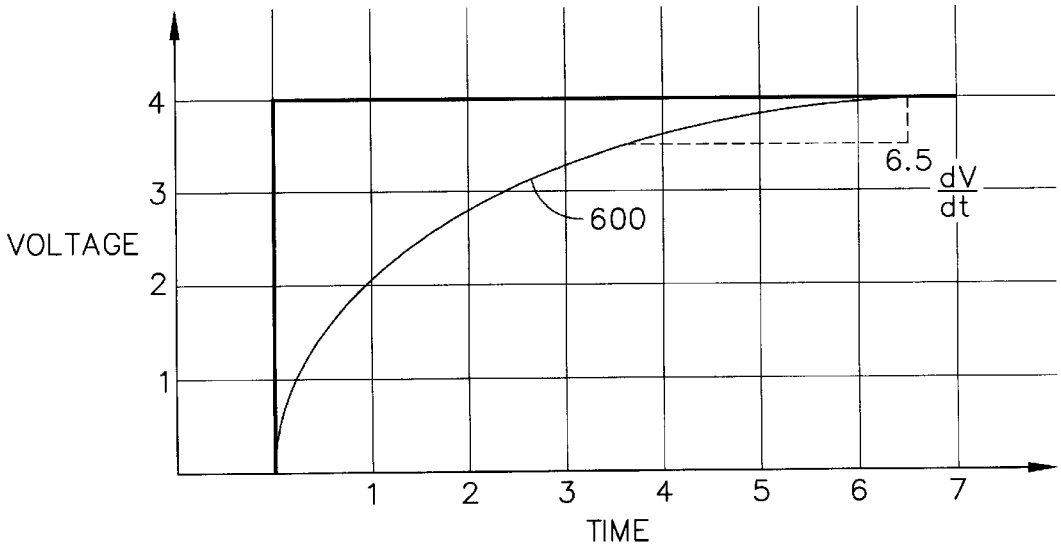
FIG. 6 CONVERGENT EXPONENTIAL WAVEFORM
(PRIOR ART)

OUTPUT WAVEFORM

OUTPUT WAVEFORM

METHOD AND APPARATUS FOR PROGRAMMABLE POWER CURVE AND WAVE GENERATOR

FIELD OF THE INVENTION

The present invention relates generally to a programmable circuit and, more particularly to a circuit for generating a programmable power curve, ramp and waveform.

BACKGROUND OF THE INVENTION

Various forms of lamps, such as fluorescent and incandescent, include at least one fragile filament. Lamp filaments and other dynamic loads exhibit impedance that varies, for example, as a function of temperature (i.e., as the temperature of the filament increases due to current-induced heating, the impedance increases). When power is supplied to the lamp, the filament is usually cold and the resistance is low. At power-up, the initial current can be as high as ten to twenty times greater than the normal operating current. Repeated cold-current surges will degrade the filament and result in premature failure of the lamp.

The high initial current can be controlled with a soft-start circuit. Soft-start circuits are used to control the rate at which power is applied to the dynamic load. Generally, it is desirable to increase the power to the load in a smooth manner. Thus, controlling the rate of power application to the lamp results in heating the filaments at a slower rate and reduces the risk of filament damage.

One soft-start technique is a "trickle current" which provides a relatively small, continuous current to the dynamic load when it is not operating. The continuous flow of current keeps the load warm and the impedance high. When full power is suddenly applied, the surge current is reduced. The trickle current system, while simplistic, does require extraneous or sequenced power supplies and does not eliminate the surge current, only reduces it. Further, the continuous supply of current required to implement this technique can be costly and inefficient.

Another technique for reducing the surge current effect is through a thermistor or other temperature dependent resistance. When power is initially applied, the current flows through the thermistor producing rapid heating and high resistance. As the thermistor heats up, the resistance stabilizes and the operating current is achieved. A thermistor is rugged and relatively inexpensive, but its behavior is difficult to predict. A thermistor also dissipates a significant amount of power during normal operation which can affect its resistive values.

A series inductor may also limit surge current in some applications which require large current. Inductive chokes are magnetic components that obey Lenz's Law. At power-on, the magnetic field created by the inductor reduces the initial current and diminishes the sudden surge current to the load. In many environments, the addition of a strong magnetic field may not be desirable. Further, inductive chokes tend to be bulky, heavy and dissipate power during normal operation.

A current regulation system including a small sense resistor coupled to the load is yet another soft-start technique. The voltage across the resistor provides feedback for controlling the power supplied to the load. Such systems offer very brief control before full power-up, usually around 20 to 100 milliseconds, and this period may be too short for applications with large initial currents or particularly sensitive loads.

SUMMARY OF THE INVENTION

The present system overcomes the prior art problems by providing a programmable circuit with low electronic component count. More particularly, the present invention provides a programmable power curve and ramp generator circuit particularly useful in a soft-start application.

In one embodiment, the programmable control circuit comprises an amplifier with positive and negative feedback. The negative feedback comprises the gain of the circuit and the positive feedback comprises a time lag. In an exemplary embodiment, the negative feedback includes a resistor (R1) and a resistor (R2). The time lag includes a resistor (R) and a capacitor (C). The control circuit effectively controls a power supply coupled to a load and reduces the high initial surge current. The circuit components and input signal may be modified to deliver a programmable power curve.

In exemplary embodiments, the programmable control circuit produces a linear ramp output by increasing the ratio of (R2) to (R1). Moreover, replacing resistor (R1) with logic diodes and/or zener diodes further improves the linearity of the ramp.

In yet another embodiment, a fixed input voltage at power-on is realized by replacing resistance (R2) with two resistors, (R2A) and (R2B), to form a voltage divider. This technique is particularly useful for soft-start functions at power-up.

In still another embodiment, a sensor coupled to a load measures a variable of interest. Measurement information is used to control the voltage input to the control circuit. In a particular embodiment, the sensor measures the temperature of the load. As the temperature of the load increases, the voltage to the control circuit is increased.

In yet another embodiment, a periodic monopolar waveform generator is realized by adding a threshold detector, a pulse generator, and a switch. A bipolar waveform can also be formed with the addition of two more switches, a flip-flop, and another input signal of opposite polarity.

BRIEF DESCRIPTION OF THE DRAWINGS

These and other features, aspects, and advantages of the present invention will become better understood with regard to the following description, appended claims, and accompanying drawings where:

FIG. 5 illustrates $$\left(\frac{dV}{dt}\right)$$

Figure 7:
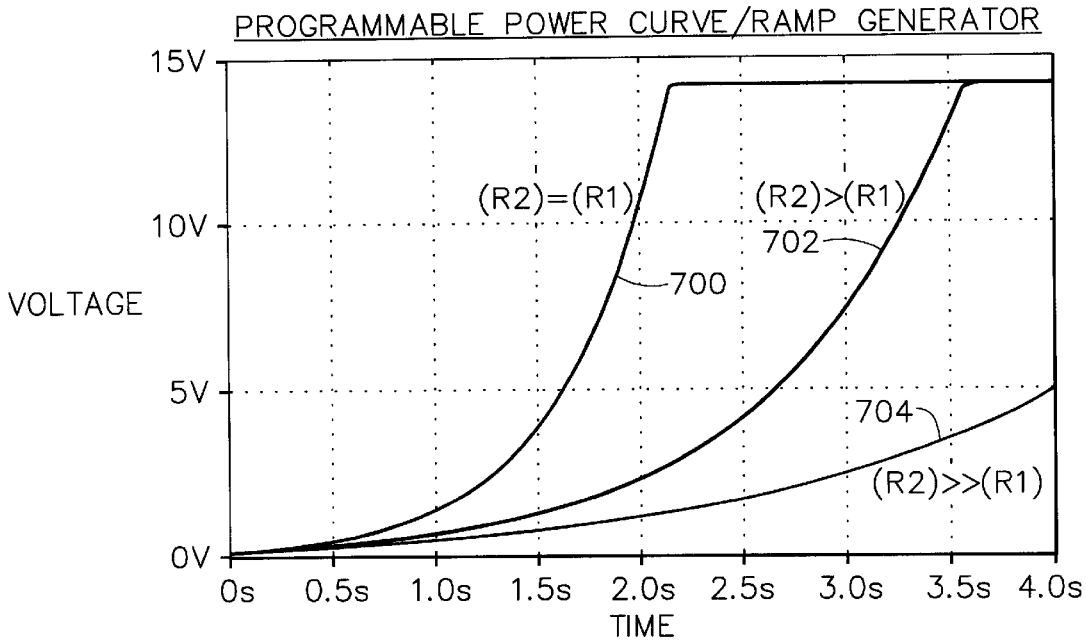
Figure 8:
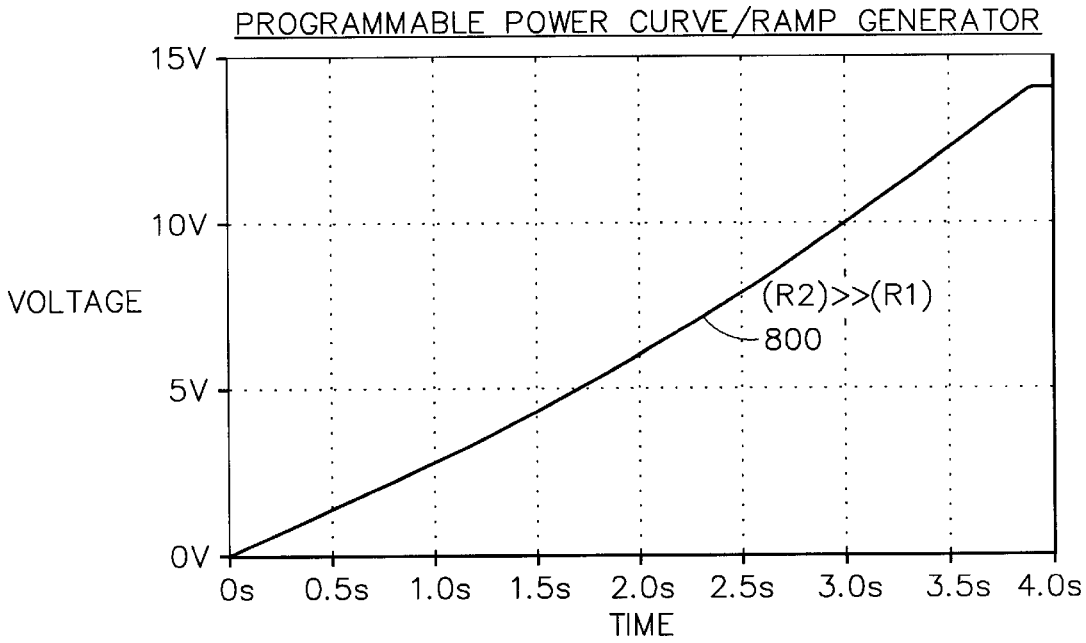
Figure 9:
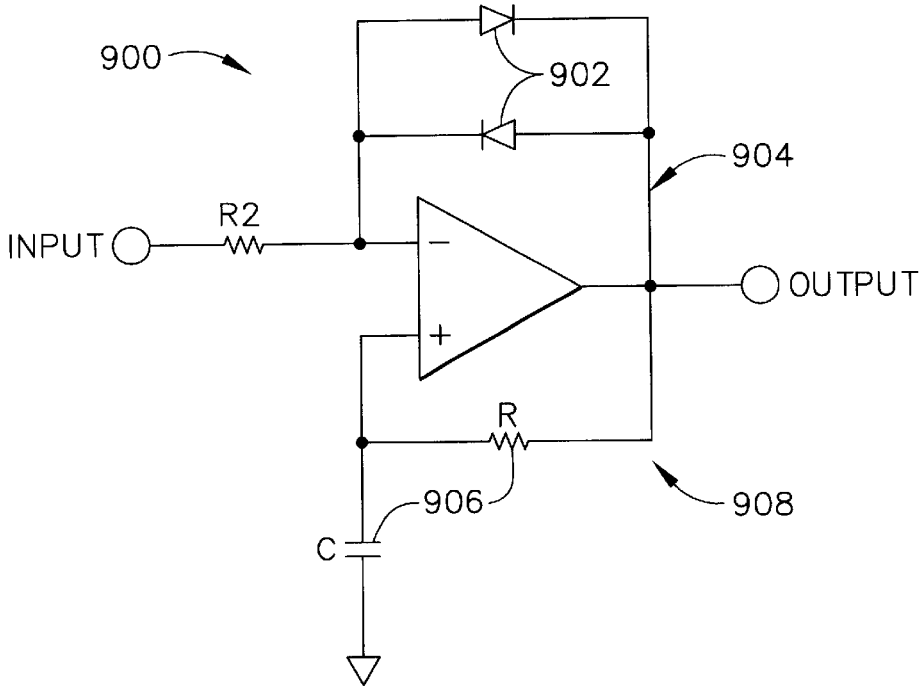
Figure 10:
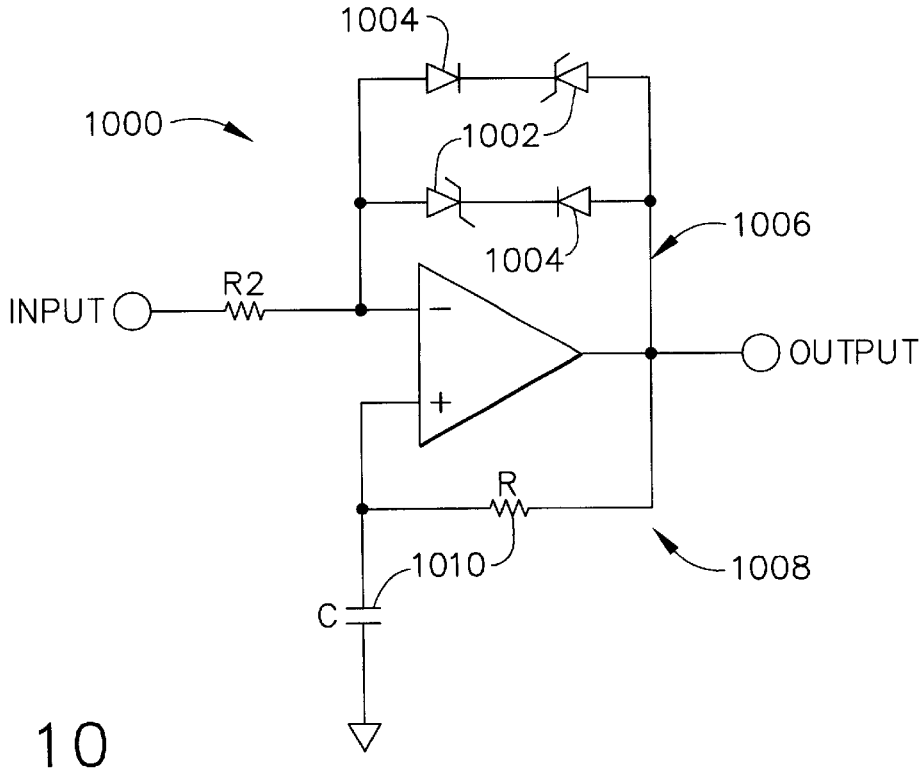
Figure 11:
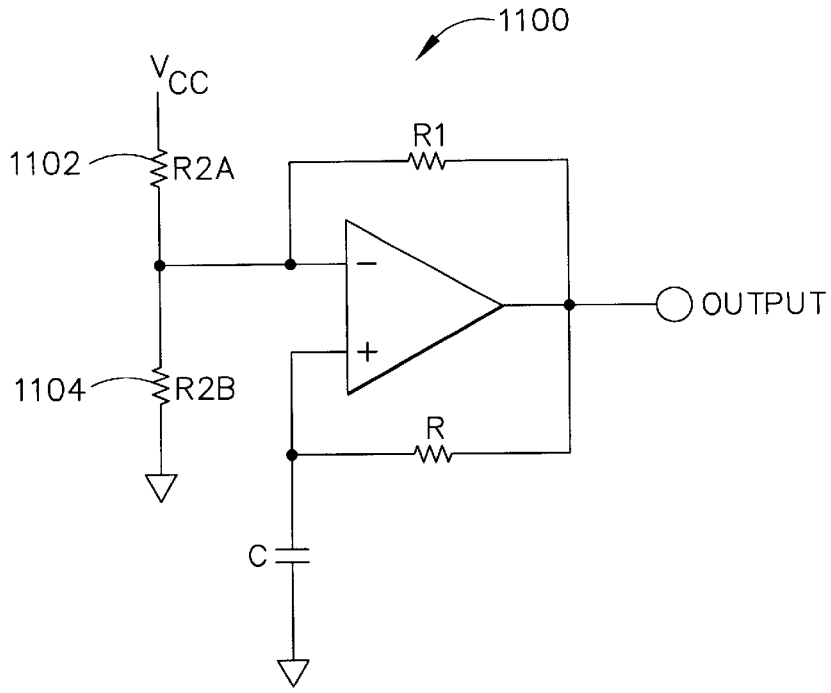
Figure 12:
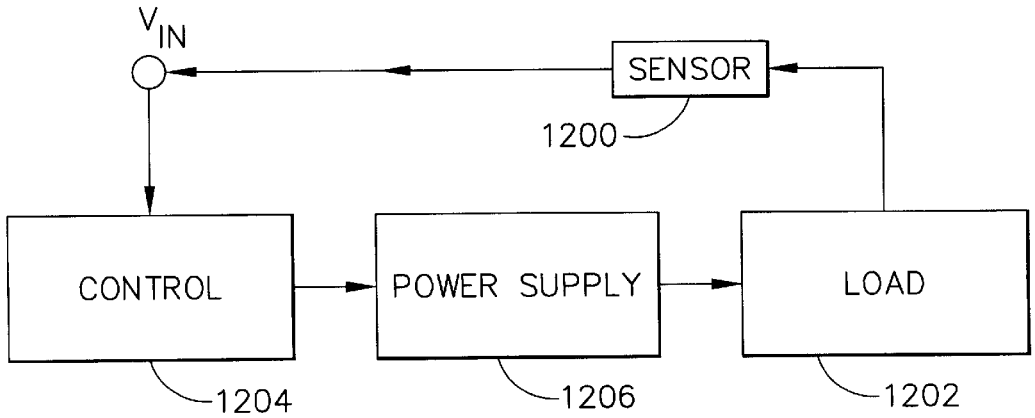
Figure 13:
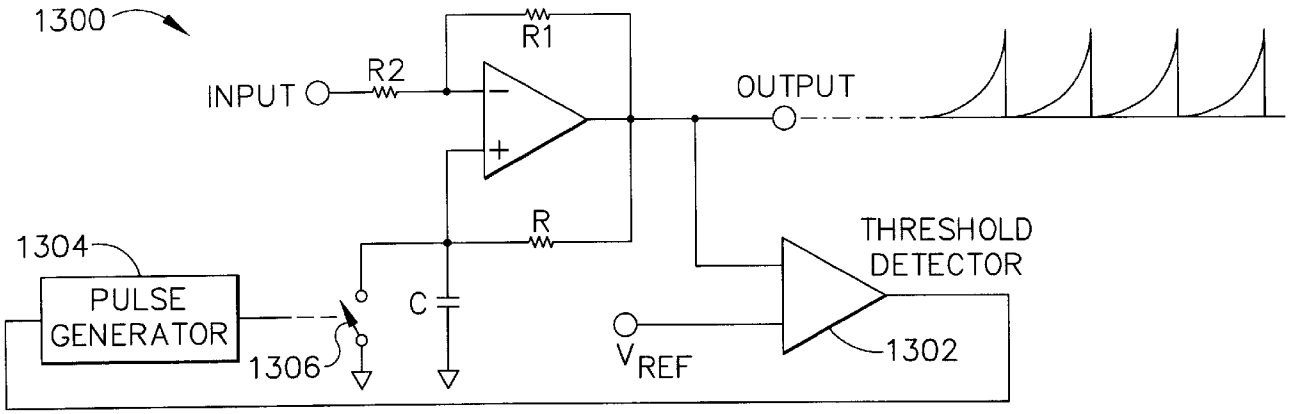
Figure 14:
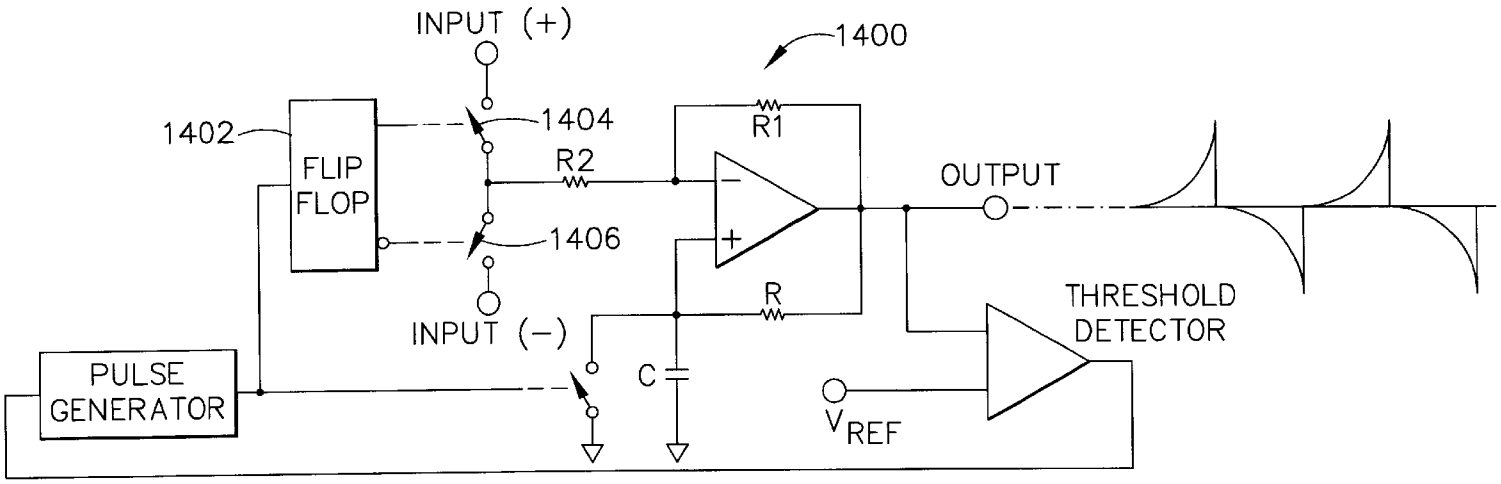

in a divergent output waveform of an exemplary programmable circuit in accordance with the present invention;

FIG. 6 illustrates $$\left(\frac{dV}{dt}\right)$$

in a convergent output waveform of the prior art;

FIG. 7 illustrates an output waveform of an exemplary programmable circuit in accordance with the present invention where the ratio of (R2) to (R1) is increased;

FIG. 8 illustrates an output waveform of an exemplary programmable circuit in accordance with the present invention where (R2)>>(R1);

FIG. 9 illustrates one embodiment in accordance with the present invention where (R1) comprises logic diodes;

FIG. 10 illustrates another embodiment in accordance with the present invention where (R1) comprises zener diodes;

FIG. 11 illustrates another embodiment in accordance with the present invention where (R2) comprises a voltage divider;

FIG. 12 illustrates in block format a sensor embodiment of the control system in accordance with t present invention;

FIG. 13 illustrates a periodic monopolar waveform generator in accordance with another embodiment of the present invention; and FIG. 14 illustrates a periodic bipolar waveform generator in accordance with another embodiment of the present invention.

DETAILED DESCRIPTION OF THE PREFERRED EMBODIMENT

The ensuing descriptions are preferred exemplary embodiments only, and are not intended to limit the scope, applicability, or configuration of the invention in any way. Rather, the ensuing descriptions provide a convenient description for implementing preferred embodiments of the invention, it being understood that various changes may be made in the function and arrangement of elements described in the preferred embodiments without departing from the spirit and scope of the invention as set forth in the appended claims.

A control system according to various aspects of the present invention controls the power supplied to a load such as, for example, a lamp. In one embodiment, the control system is particularly configured to control the initial current which can damage a lamp filament. In addition, the control system of the present invention is particularly suited for lamps used in backlighting a liquid crystal display (LCD) used in various applications such as, for example, avionics displays, laptop computers, video cameras and automatic teller machine displays. Those of skill in the art will recognize that the present control system may be used in any suitable application which may be subject to damage or other adverse effects due to a high initial current.

Figure 1:
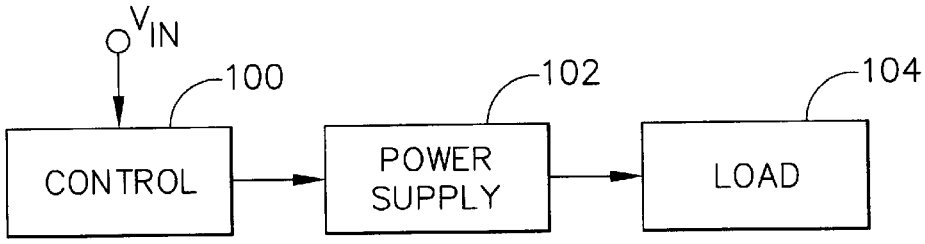
FIG. 1 illustrates in block format a control system in accordance with the present invention.

Referring to FIG. 1, a control system 100 according to various aspects of the present invention controls the current application of power from power supply 102 to load 104. In general, load 104 represents any current-sensitive load that can be damaged by a surge current at start-up. One skilled in the art will recognize that power supply 102 may be determined by the type of load. For example, power supply 102 may be any controllable power supply such as, but not limited to, switching power supplies (e.g., pulse width regulator) and linearly regulated power supplies.

Figure 2:
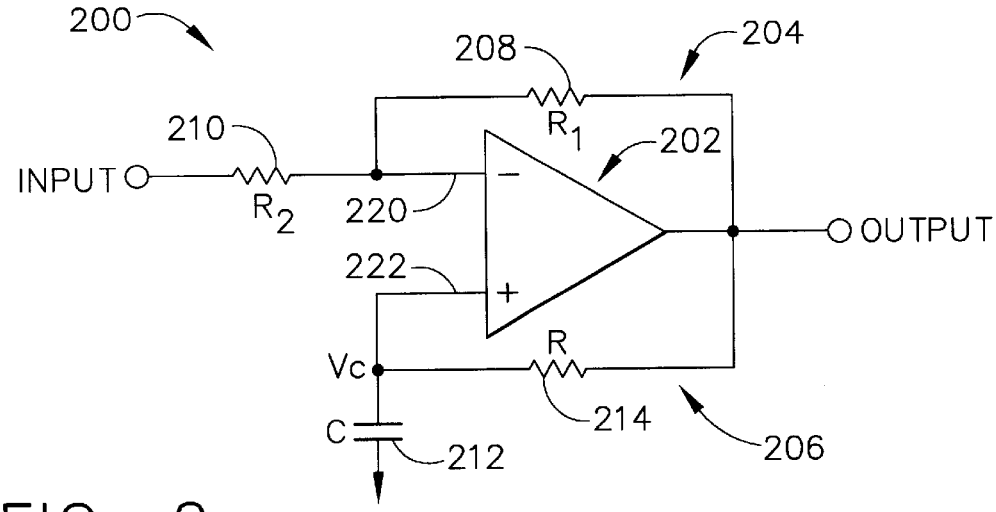
FIG. 2 illustrates an exemplary programmable circuit diagram in accordance with the present invention.

Referring to FIG. 2, control circuit 200 includes an amplifier 202 having a negative feedback 204 and a positive feedback 206. As shown, amplifier 202 may comprise a conventional operational amplifier ("op amp") such as, but not limited to, the 741-type op amp.

In one exemplary embodiment, negative feedback 204 comprises a resistor (R1) 208 in electrical communication with a resistor (R2) 210. Positive feedback 206 comprises a standard RC (resistor 214, capacitor 212) lag which is practical and programmable. Typically amplifiers require DC power to operate. Therefore, the input voltage to control circuit 200 is constant and does not vary with time. However, the input voltage may be varied in magnitude to modify the output.

Figure 3:
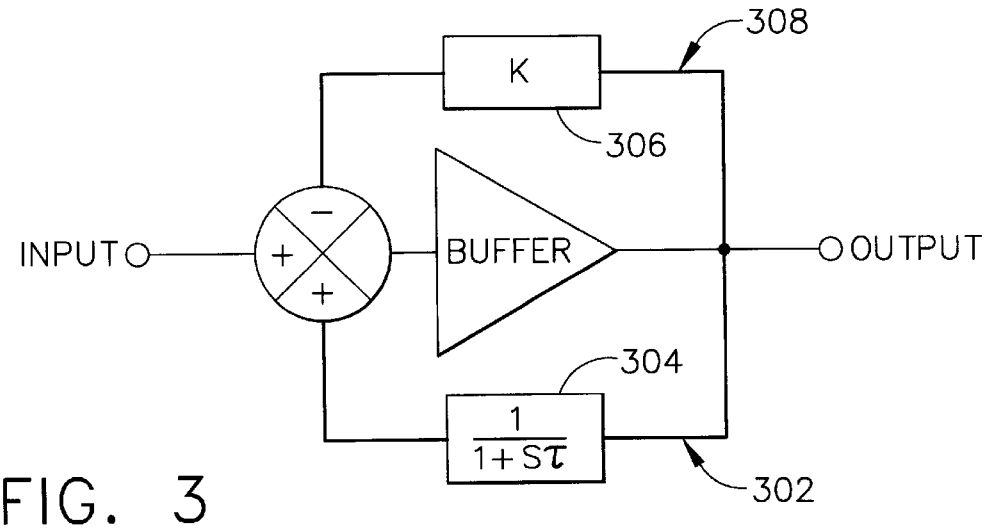
FIG. 3 depicts FIG. 2 in block format.

The circuit may be more easily understood with reference to the exemplary block diagram of FIG. 3. Positive feedback 302 behaves as a lag and can be designed to modulate the rate of change 304 of the circuit. The gain 306 of the circuit may be varied by changing the value of the components in negative feedback 308.

Figure 4:
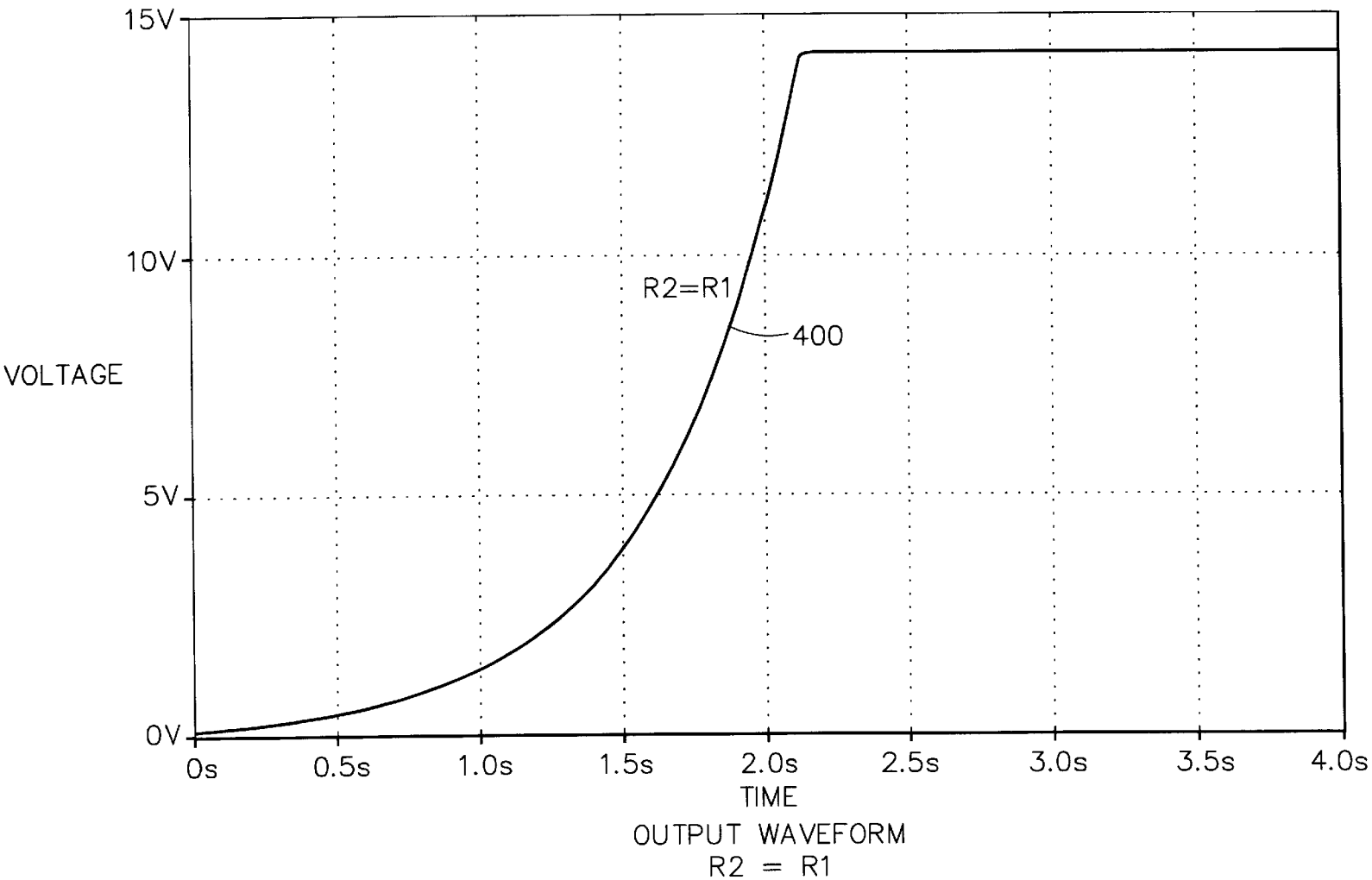
FIG. 4 illustrates an output waveform of an exemplary programmable circuit in accordance with the present invention where (R2)=(R1)

With reference to FIG. 4, a sample output waveform of the circuit shown in FIG. 2 is illustrated. In this example, assume the value of resistor (R1) 208 is set substantially equal to the value of resistor (R2) 210 and capacitor 212 is completely discharged. In operation, applying a small voltage to the input of the circuit results in a voltage output equal in magnitude to the input but opposite in polarity. Because the inverting input 220 and non-inverting input 222 of amplifier 202 must be at the same potential, no charge is yet accumulated on capacitor 212. However, capacitor 212 begins charging almost immediately via resistor (R) 214 with a charge current equal to the output voltage divided by the resistance 214. As capacitor 212 charges, the voltage at non-inverting input 222 begins to exponentially increase. The voltage at inverting input 220 mimics the voltage at non-inverting input 222. This action causes the voltage at the output to increase, which in turn increases the charging current to capacitor 212. This operation causes the output voltage to the power supply to gradually increase and will continue until the limitations of the control circuit are reached.

In one embodiment of circuit 200 of the present invention, (R2) is approximately equal in value to (R1). With continued reference to FIG. 4, it is apparent from waveform 400 that there is a significant period prior to full operating power when (R2) is approximately equal to (R1). In addition, it is clear from FIG. 4 that if (R2) is approximately equal to (R1), a divergent exponential function results.

Referring now to FIG. 5, the voltage output waveform of the circuit of FIG. 2 is illustrated. Waveform 500 diverges because the current charging capacitor 212 continually increases instead of decreases. As the voltage at non-inverting input 222 increases, the voltage at inverting input 220 also increases. Capacitor 212 begins charging almost immediately and continues to increase until the voltage limits are reached. The negative and positive feedback 204, 206 of the present invention produce the divergent output waveform with the depicted rate of change.

FIG. 6 illustrates the signal from a prior art amplifier. FIGS. 5 and 6 are normalized with respect to time and voltage for exemplary purposes. The prior art circuit represented by waveform 600 exhibits an abrupt jump in voltage output at time equal to 1. In fact, at time equal to 1, waveform 600 is already at one half of the full operating power. In comparison, at this same time, exemplary waveform 500 of the present invention has only slightly increased in voltage and does not reach half operating power until after time equal to 6. Avoiding sharp increases in output voltage, especially at start-up, reduces the damaging stress on the load and increases the operating lifetime of the load.

Another advantage of the divergent waveform of the present invention is further demonstrated by comparing waveforms 500 and 600. Typically, exponential output waveforms (convergent and divergent) maintain a smooth shape. Differences between the two exponential waveforms lie in the rate of increase. The change in voltage with respect to time, $$\left(\frac{dV}{dt}\right),$$

is the rate at which the voltage changes over time. With reference to FIG. 6, $$\left(\frac{dV}{dt}\right)$$

is illustrated near the horizontal asymptote of waveform 600. At time equal to 6.5, $$\left(\frac{dV}{dt}\right)$$

has covered approximately 3 units of time (i.e., 3.5 to 6.5). Exemplary waveform 500 of the present invention has a much smaller $$\left(\frac{dV}{dt}\right)$$

of only ½ unit of time (i.e., 6.0 to 6.5) near the vertical asymptote. Therefore, in the interval of interest, waveform 500 exhibits a greater rate of voltage change. The output waveform of the present invention avoids rapid initial increases in voltage change while steadily increasing the voltage to the power supply of the load. Gradually increasing power, in accordance for example, with the exemplary power waveform of FIG. 5, results in an efficient application of power (i.e., the power supply applies power as the circuit "warms up").

Another advantage of the present invention, also illustrated by FIGS. 5 and 6, is the precision timing achievable by the present invention. Referring again to waveform 600, $$\left(\frac{dV}{dt}\right)$$

has covered approximately 3 units of time. This means that a change in voltage occurring at the output of the prior art circuit will occur somewhere within these 3 units of time. On the other hand, waveform 500 covers a much smaller $$\left(\frac{dV}{dt}\right)$$

equal to approximately ½ unit of time. The smaller interval enables a higher level of accuracy in pinpointing the time of the voltage on waveform 500.

Yet another advantage of the present invention, is its programmability. By increasing, decreasing or modifying the values of the electrical components of control circuit 200 and/or changing the input signal to the circuit, the performance of the circuit can be programmed. For particular loads in specific environments, the exponential nature of the increase in voltage during start-up may not be desirable. Rather, such applications may require a lower rate of change or a linear power curve.

To illustrate the flexibility of the present invention, FIG. 7 shows the resulting output waveforms as resistors (R2) and (R1) are varied. As a reference, waveform 400 is duplicated as waveform 700 to illustrate an exemplary output when (R2) is substantially equal to (R1). As the ratio of (R2) to (R1) increases, the voltage at the output of control circuit 200 relative to inverting input 220 becomes relatively constant as capacitor 212 charges. This in turn supplies capacitor 212 with a current that is substantially constant and causes capacitor 212 to charge linearly. As the ratio of (R2) to (R1) further increases, the rate of change further increases as illustrated by exemplary output waveform 702. Output waveform 704 and, more particularly, output waveform 800 of FIG. 8 illustrate the near-perfect linearity of the output of circuit 200 as the ratio of (R2) to (R1) increases.

In another embodiment of present invention, (R1) is replaced with one or more logic diodes. Referring now to FIG. 9, control circuit 900 comprises two diodes 902 in negative feedback 904 and a RC lag 906 in positive feedback 908. In this embodiment, diodes 902 are connected in parallel but in opposite direction, thereby allowing bipolar operation. Thus, the output may travel in either a positive or negative direction. The diode configuration causes the voltage across resistor (R) to become constant which in turn supplies capacitor (C) with a constant current. Capacitor (C) is now charging linearly instead of exponentially. The voltage drop across diode 902 increases logarithmically with the increase in current, and decreases linearly with an increase in temperature. The current and temperature effects cause only slight yet noticeable variations. Thus, the input voltage and ambient temperature are dependant variables in system 900.

The output waveform (not shown) may be programmed to control the slope of the amp (e.g., a linear ramp which steadily increases) by changing the input signal and/or the values of (R) and (C) and more specifically according to the formula $$\left(\frac{dV}{dt} = \frac{i}{C}\right),$$

where i is the current to capacitor (C). One skilled in the art will readily recognize the capacitor formula and appreciate the inherent programmability of the present invention. For example, (R) (or any of the resistors in the circuits) can comprise a digital resistor or digital potentiometer. The potentiometer can be controlled by, for example, digital hardware (e.g., chip) and/or software (e.g., computer program).

In FIG. 10, another embodiment of the present invention, negative feedback 1006 comprises one or more zener diodes 1002 and an equal number of logic diodes 1004, and positive feedback 1008 comprises a RC lag 1010. Logic diodes 1004 are placed in series with each zener diode 1002 for bipolar operation. This configuration prevents the zener diodes from behaving like logic diodes in the reverse direction. Replacing (R1) with a combination of zener diodes 1002 and logic diodes 1004 forces the voltage across resistor (R) to remain constant. The current to capacitor (C) is also constant thus causing capacitor (C) to charge linearly. Unlike exemplary system 900, the zener diode configuration of FIG. 10 is neither voltage nor temperature dependent. Because the voltage of zener diodes 1002 is large in comparison to the change in voltage of diodes 1004, the change goes unnoticed by circuit 1000. Zener diodes 1002 are chosen to achieve temperature invariance by, for example, having a temperature coefficient complimentary to logic diodes 1004.

FIG. 11 illustrates still another embodiment of the present invention comprising a voltage divider circuit. Resistor (R2) is replaced by resistors (R2A) 1102 and (R2B) 1104 in circuit 1100. Resistors 1102 and 1104 are electrically connected to form a voltage divider. This embodiment is especially suited for one time soft-start functions at power up and then repeat only when power is applied again. Further, this embodiment utilizes the existing power supplies necessary to power the other circuitry such as the amplifier.

The physical variables of the load can directly influence the amount of current the load can accept. For example, a lamp filament used in a display system of an airplane cockpit may experience drastic temperature changes depending on where the plane is flying. In warmer climates, the lamp filament can withstand higher currents in less time and is usually brought to full operating current rapidly. However in colder climates, the cold lamp filament requires a slower application of current and is more susceptible to damage if current is suddenly applied.

With reference to FIG. 12, another embodiment of the present invention includes a sensor device to monitor the temperature of the load. Control system 1204 controls the application of power from power supply 1206 to load 1202. It is advantageous to determine the optimal rate to supply full operating current (e.g., when the load is properly "warmed-up"). Sensor 1200 is suitably coupled to load 1202 to receive periodic temperature readings from the load. Temperature information is transmitted from sensor 1200 to the voltage input of control 1204. The voltage input is increased relative to the increase in temperature of load 1202. Thus, as the load temperature increases indicating more power can be safely supplied, the voltage input is adjusted accordingly. This exemplary configuration permits the lower rates of change needed to reduce load damage in, for example, severely cold climates. Those skilled in the art will recognize that similar physical variables which can effect the amount of power supplied to a load may be monitored and are intended to be included in the scope of this invention (e.g., humidity, light, pH, pressure, available power).

Further embodiments of the control circuit of the present invention can be used for, but not limited to, testing particular types of loads. As mentioned earlier, the unique combination of both positive and negative feedback generates a divergent waveform. The divergent waveform of the present invention can be replicated in a pulse pattern. Referring now to FIG. 13, a monopolar periodic waveform generator 1300 is disclosed in accordance with the present invention. In this embodiment, the circuit configuration of FIG. 2 having both positive and negative feedback is coupled to a threshold detector 1302, a pulse generator 1304 and a switch 1306. One skilled in the art will quickly recognize the functions of the circuit.

For some applications, it is desirable to generate both positive and negative pulses. The embodiment of FIG. 13 can be enhanced to produce a bipolar periodic waveform. In addition to the exemplary components of FIG. 13, circuit 1400 of FIG. 14 comprises a flip-flop 1402, a second voltage supply (noted generally from FIG. 14 as "Input (+) and Input (−)"), and at least two additional switches 1404 and 1406. The additional switches 1404 and 1406 each receive an input voltage signal of opposite polarity from the other.

The present invention has been described above with reference to preferred embodiments. However, those skilled in the art having read this disclosure will recognize that changes and modifications can be made to the preferred embodiments without departing from the scope of the present invention. These and other changes or modifications are intended to be included within the scope of the present invention, as expressed in the following claims.

What is claimed is:

1. A programmable control circuit comprising:

an amplifier having a voltage input and a voltage output, said amplifier operated to saturation and configured to generate a divergent waveform;

a negative feedback electrically connecting said voltage input and said voltage output; and a positive feedback electrically connecting said voltage input and said voltage output.

2. The circuit of claim 1 wherein said negative feedback comprises a resistor (R1) and a resistor (R2) in electrical connection.

3. The circuit of claim 2 wherein said resistor (R1) and said resistor (R2) are substantially equal in value.

4. The circuit of claim 1 further comprising a sensor coupled to a load, said sensor monitoring a physical variable of the load.

5. The circuit of claim 2 wherein said positive feedback comprises a resistor (R) and a capacitor (C) in electrical connection.

6. The circuit of claim 5 wherein at least one of said resistors comprises a digital potentiometer.

7. The circuit of claim 1 wherein said negative feedback comprises at least one logic diode.

8. The circuit of claim 7 wherein said negative feedback comprises at least one zener diode.

9. The circuit of claim 2 wherein said resistor (R2) comprises a voltage divider.

10. The circuit of claim 1 further comprising:

a threshold detector, having at least one detector input and one detector output said detector input coupled to said voltage output;

a pulse generator coupled to said detector output; and a first switch coupled to said pulse generator to receive a pulse.

11. The circuit of claim 10 further comprising:

a flip-flop having first and second output leads and an input lead, said input lead coupled to said pulse generator; and a second switch coupled to said flip-flop first output lead to receive a voltage at said voltage input; and a third switch coupled to said flip-flop second output lead to receive an opposite polarity voltage at said voltage input.

12. The circuit of claim 8 wherein said divergent waveform comprises a near-linear ramp.

13. A programmable control circuit comprising:

an amplifier having a voltage input and a voltage output;

a negative feedback electrically connecting said voltage input and said voltage output;

a positive feedback electrically connecting said voltage input and said voltage output;

a threshold detector, having at least one detector input and one detector output said detector input coupled to said voltage output;

a pulse generator coupled to said detector output;

a first switch coupled to said pulse generator to receive a pulse;

a flip-flop having first and second output leads and an input lead, said input lead coupled to said pulse generator;

a second switch coupled to said flip-flop first output lead to receive a voltage at said voltage input; and a third switch coupled to said flip-flop second output lead to receive an opposite polarity voltage at said voltage input.

14. A method for generating a programmable power curve in a soft-start circuit comprising the steps of:

providing an amplifier having an input terminal and an output terminal;

configuring said amplifier to generate a divergent output waveform;

applying a potential at said input terminal and increasing said potential until a maximum level of said amplifier is reached; and coupling said output terminal to a power source of a load.

15. The method of claim 14 wherein said configuring step comprises:

connecting a positive feedback between said input and output terminals; and connecting a negative feedback between said input and output terminals.

16. The method of claim 14 wherein said applying step comprises varying the magnitude of the potential.

17. The method of claim 14 further comprising the steps of:

coupling a sensing device to said input terminal and the load, wherein the load having a current-sensitive characteristic;

receiving data at said sensing device corresponding to the current-sensitive characteristic; and controlling the potential to said input terminal in response to the data.

18. The method of claim 17 wherein said receiving data step comprises temperature.

19. The method of claim 15 wherein said connecting a positive feedback comprises a resistor and a capacitor in electrical connection.

20. The method of claim 15 wherein said connecting a negative feedback comprises a first resistor (R1) and a second resistor (R2) in electrical connection.

21. The method of claim 20 further comprising the step of modifying the values of said first and second resistors in response to an increase in a voltage rate of change of said divergent output waveform.

22. A programmable circuit for generating a periodic waveform comprising;

an amplifier having a voltage input, a voltage output, a negative feedback and a positive feedback, wherein said negative and positive feedbacks are electrically connected between said voltage input and said voltage output;

a threshold detector having at least one detector input terminal connected to said operational amplifier and one detector output terminal;

a pulse generator connected to said detector output terminal;

a switch coupled to receive a pulse from said pulse generator;

a flip-flop having first and second output leads and one input lead, said input lead coupled between said pulse generator and said switch; and a second power input with opposite polarity to that of said first input, wherein said first and second power inputs form a first and a second switch at said first and second flip-flop output leads and the periodic waveform appears at said voltage output.

23. A soft-start circuit comprising:

an amplifier having an input and an output;

gain means coupled between said input and said output; and time lag means coupled between said input and said output, whereby, said circuit being configured to produce a programmable power curve representative of the output of said circuit as a voltage is applied from a beginning voltage until circuit saturation.

24. The soft-start circuit of claim 23 wherein said power curve is a divergent waveform.

25. The soft-start circuit of claim 23 wherein said power curve is a linear ramp.

26. The soft-start circuit of claim 23 wherein said gain means comprises a negative feedback.

27. The soft-start circuit of claim 23 wherein said gain means comprises a negative feedback having two resistors in electrical communication.

28. The soft-start circuit of claim 23 wherein said gain means comprises a negative feedback having two substantially equal resistors in electrical communication.

29. The soft-start circuit of claim 25 wherein said gain means comprises at least one diode.

30. The soft-start circuit of claim 23 wherein said time lag means comprises a resistor and a capacitor in electrical communication.

* * * * *